US008099914B2

(12) United States Patent
Reaveley et al.

(10) Patent No.: US 8,099,914 B2
(45) **Date of Patent: *Jan. 24, 2012**

(54) PERFORATED PLATE SEISMIC DAMPER

(75) Inventors: Lawrence D. Reaveley, Salt Lake City, UT (US); Tyler J. Ross, Port Hueneme, CA (US)

(73) Assignee: The University of Utah Research Foundation, Salt Lake City, UT (US)

( * ) Notice: Subject to any disclaimer, the term of this patent is extended or adjusted under 35 U.S.C. 154(b) by 505 days.

This patent is subject to a terminal disclaimer.

(21) Appl. No.: 12/116,061

(22) Filed: May 6, 2008

(65) Prior Publication Data

US 2008/0271389 A1 Nov. 6, 2008

Related U.S. Application Data

(63) Continuation-in-part of application No. 11/928,622, filed on Oct. 30, 2007.

(51) Int. Cl.
*E04B 1/98* (2006.01)

(52) U.S. Cl. ..... 52/167.3; 52/167.9

(58) Field of Classification Search ..... 52/167.3, 52/167.4, 167.9

See application file for complete search history.

(56) References Cited

U.S. PATENT DOCUMENTS

| | | | | | |
|---|---|---|---|---|---|
| 4,027,389 | A * | 6/1977 | Atchisson | 30/303 |
| 4,373,649 | A * | 2/1983 | Ninomiya | 224/163 |
| 4,480,731 | A * | 11/1984 | Izeki et al. | 188/381 |
| 4,502,219 | A * | 3/1985 | Hibben | 30/153 |
| 4,606,125 | A * | 8/1986 | Jensen | 30/302 |
| 4,765,628 | A * | 8/1988 | Jensen | 473/589 |
| 4,805,359 | A * | 2/1989 | Miyake et al. | 52/167.6 |
| 4,807,362 | A * | 2/1989 | Prentice | 30/155 |
| 5,161,655 | A * | 11/1992 | Shimoda | 188/371 |
| 5,509,238 | A * | 4/1996 | Scalfati | 52/167.7 |
| 6,243,998 | B1 * | 6/2001 | MacKarvich | 52/167.3 |
| 6,389,761 | B1 * | 5/2002 | McKinnon | 52/167.3 |
| 6,651,395 | B2 * | 11/2003 | Capra | 52/167.8 |
| D510,009 | S * | 9/2005 | Lee | D8/99 |
| D557,330 | S * | 12/2007 | Parikh et al. | D17/20 |
| 2005/0155483 | A1 * | 7/2005 | Anderson | 84/422.3 |
| 2006/0150538 | A1 * | 7/2006 | Thomas | 52/167.3 |
| 2008/0022610 | A1 * | 1/2008 | Gjelsvik et al. | 52/167.3 |
| 2010/0107519 | A1 | 5/2010 | Reaveley | |

OTHER PUBLICATIONS

U.S. Appl. No. 11/928,622, filed Oct. 30, 2007, Reveley.

(Continued)

*Primary Examiner* — Eileen D Lillis
*Assistant Examiner* — Alp Akbasli
(74) *Attorney, Agent, or Firm* — Workman Nydegger

(57) ABSTRACT

The present invention relates to apparatus and systems for absorbing seismic energy to prevent non-linear displacement in a structure. A seismic damper according to embodiments of the present invention includes at least one flat plate which can be perforated to include a plurality of apertures and/or cut-outs. Interior apertures are formed in the flat plate, and one or more cut-outs along outer edges. Nodes are defined between the apertures and the cut-outs and stresses from transferred energy focus on the nodes to reduce non-linear displacement of a brace system to which the seismic damper is attached. One or more tension straps can be attached to the flat plate. The interior apertures may include a single aperture, or multiple apertures. The apertures may include slots. Two plates may be connected and rotated relative to each other placing the apertures out of alignment. Tension straps can be rotated relative to each other.

14 Claims, 9 Drawing Sheets

OTHER PUBLICATIONS

Restriction Requirement dated Jul. 9, 2010 from U.S. Appl. No. 11/928,622.

Office Action dated Nov. 24, 2010 from U.S. Appl. No. 11/928,622.

U.S. Appl. No. 11/928,622, Mail Date Jun. 28, 2011, Notice of Allowance.

* cited by examiner

PERFORATED PLATE SEISMIC DAMPER

CROSS-REFERENCE TO RELATED APPLICATIONS

The present application is a continuation-in-part of, and claims the benefit of, and priority to, U.S. patent application Ser. No. 11/928,622, filed on Oct. 30, 2007, and entitled "Perforated Plate Seismic Damper," which claims the benefit of, and priority to, U.S. Provisional Application Ser. No. 60/863,561, filed on Oct. 30, 2006, and entitled "Perforated Plate Seismic Damper", which applications are each expressly incorporated herein by this reference.

BACKGROUND OF THE INVENTION

1. The Field of the Invention

Exemplary embodiments of the invention relate to the field of energy absorption. More particularly, the invention relates to apparatus and systems for absorbing and dissipating seismic energy.

2. The Relevant Technology

Building codes are set in place so that buildings, whether residential or commercial structures, are designed and constructed to have in place a minimum set of standards designed to allow the building to withstand tension and compression cycles. Such cycles may come about from any of a variety of different sources. For instance, such tension and compression cycles may be induced by earthquakes, winds, and other natural and/or man-made phenomena. For example, when an earthquake or similar event occurs, energy from the earthquake is transferred to the structure, causing the structure to oscillate, thereby also causing the structure and its support members to undergo a number of tensile and compressive cycles. Hopefully, in such an energy-inducing event (i.e. if the building codes are met, and the energy-inducing event is of a size less than the maximum for which the building codes were designed), the structure can withstand the tensile and compressive cycles without buckling or excessive deformation.

To meet these building codes, a frame-based structure can be designed and constructed with stiff cross-members which act as braces to withstand any compressive and tensile cycles occurring as a result of linear displacement. Typically, building code standards do not, however, require structures to exhibit high-energy dissipating characteristics that would allow for multiple cycles of non-linear displacement. Thus, a large earthquake, which may cause the structure to undergo non-linear displacement, may cause significant damage to the buildings despite compliance with the building codes. In particular, such structures are vulnerable to deformation and buckling in the event of a large earthquake or similar energy-inducing event which causes non-linear displacement and/or stress cycles above and beyond the minimum stresses that compliance with the building codes should withstand. Moreover, such problems are magnified in structures which have multiple stories as inter-story drift can be created which causes the stories to shift relative to each other.

To prevent or reduce the damage in the event of a major seismic event, structural dampers may be used which absorb high amounts of energy generated by the seismic event so as to reduce the displacement of the structure. In some cases, this damage is mitigated by limiting the structure to linear displacement where the stiff-cross members and bracing structures are less subject to deformation and buckling.

Exemplary structural dampers that can be used in this manner include various fluid-based and visco-elastic dampers. Each of these types of dampers are useful in that their components absorb the energy applied by a seismic event and thereby reduce structural displacement. Nevertheless, such damping structures are also very specialized and expensive. As a result, such devices are typically limited to high-cost applications which require high-performance capabilities.

Accordingly, what are desired are apparatus and systems which provide a low-cost structural damper which can absorb significant amounts of energy to reduce displacement and damage to a structure. It is also desired to provide structural damping apparatus and systems which can be implemented in connection with new construction or which can be efficiently installed to retrofit and rehabilitate existing structures.

BRIEF SUMMARY OF THE INVENTION

Exemplary embodiments of the invention relate to a seismic damper which, when fixed to a structure, can absorb significant amounts of energy through deformation, thereby reducing the overall displacement and damage to a structure. A seismic damper of the system can include a single plate which is attached to two or more cross-members of a support structure. The single plate can include fuse areas configured to deform as a structure experiences seismic accelerations, and which can accumulate such deformation through multiple cycles. In embodiments in which a single plate damper is used, the damper can be simply and efficiently fabricated at low cost, thereby also allowing the damper to be cost efficiently replaced after excessive deformation or to be cost effectively installed in retrofit applications.

According to one embodiment of the present invention, a seismic damper is constructed to include a substantially flat plate. The substantially flat plate can also include a plurality of nodes along each side of the flat plate, and a plurality of tabs at each corner of the plurality of tabs, such that the tabs intersect at the nodes. The nodes can further be defined as the portions of the flat plate situated between an aperture within the flat plate and each of a plurality of cut-outs formed along each which has one or more apertures formed in the flat plate and one or more cut-outs formed along an outer edge of each side of the flat plate. Such a flat plate can be of any suitable shape and can be, for example, substantially square, having a thickness substantially less than the length of each of the four sides of the square.

The aperture and/or cut-outs can also have any suitable shape or size. For instance, an aperture may be circular or generally diamond-shaped. The cut-outs may be, for example, shaped to correspond to a portion of a circle and can thus be semi-circular in some cases. Furthermore, the aperture may be substantially centered in the flat plate and the cut-outs can be substantially centered along a respective edge of the flat plate. In other cases, the aperture and/or cut-outs may not be centered in such a manner.

According to another embodiment of the present invention, a perforated flat plate is used to form a seismic damper for use in substantially eliminating non-linear displacement in an attached support structure. The flat plate has a regular geometric shape and includes a central aperture formed in and extending through the flat plate. At least one cut-out is also formed and centered along each side of the regular geometrically shaped flat plate, and each cut-out has a curved shape that is either a semi-circle or an are. A tab is further formed at each corner of the flat plate and each tab intersects two adjacent tabs at a node, thereby forming an equal number of tabs and nodes. Each tab may further be adapted so that it can be connected to a member of a diagonal brace system. For instance, each tabs may connect to a member of the diagonal brace structure such that when the corresponding member of the diagonal brace structure undergoes tension or compression, the connected tab undergoes a corresponding tension or compression.

Such a seismic damper may also include a fuse area centered on each node. In some cases, the nodes also concentrate forces applied to the perforated flat plate at the fuse areas. The fuse areas may have any suitable shape and, in some cases, are substantially hourglass shaped. In the same, or other cases, the fuse area may also have a length of any suitable size, including a length which is less than that of an adjacent cut-out.

While the plate and aperture can have any suitable shape, in some cases both are regular geometric shapes. For example, both can have about the same geometric shape, as in a case in which the plate is square and the aperture is substantially square or diamond-shaped. In other cases, the flat plate and aperture have different regular geometric shapes, such as when the flat plate is square and the aperture is substantially circular.

In another embodiment, a seismically damped structural system is disclosed which includes multiple cross-members intersecting at a particular location. A single plate seismic damper can also be attached to each cross-member at the particular location. Such a single plate seismic damper can have any suitable configuration. For instance, the seismic damper can include a flat plate that has one or more apertures formed therein, and one or more cut-outs formed therein. The aperture may be formed inside the flat plate and extend through the thickness of the plate. The cut-outs may also extend through the thickness of the plate, but may be formed in an edge of each side of the flat plate. In this manner, the aperture and cut-outs can define a plurality of tabs at each corner of the flat plate, and a node between each adjacent tab. The nodes may also have a width which varies substantially across the length of the node and can be configured such that when a force is applied to the cross-members and transferred to the flat plate, the transferred force is substantially concentrated at the nodes.

In some cases, the particular location at which the seismic damper is attached is substantially centered on the plurality of cross-members. Additionally, the nodes may further include a fuse area such that when the force is transferred to the flat plate, the concentration of the force is substantially contained within the fuse area. The fuse area may be rectangular, square, hourglass shaped, or may have any other suitable shape or configuration. Irrespective of its shape, the fuse area can be adapted to non-elastically deform when sufficient force is applied. In such a case, the non-elastic deformation of the fuse area may absorb forces applied to the cross-members and substantially limits the cross-members to linear displacement.

Non-elastic deformation may occur, for example, when there are large seismic events. Further, the single plate damper may be replaceable and selectively removable so that it can be replaced after deformation occurring in one or more seismic events.

In another embodiment a seismic damper includes a substantially flat plate configured to be attached to a structure and absorb energy therefrom, and includes a substantially flat plate. The flat plate includes nodes that are each formed along a respective edge of the flat plate, and wherein each node is a narrowing portion between one or more internal perforations in the plate and an edge cut-out formed along a respective edge of the plate. The flat plate also defines multiple tabs that intersect with adjacent tabs at the nodes.

As a flat plate, the plate can include opposing faces (e.g., a top face and a bottom face, a left face and a right face, or arbitrary faces), while the perforations intersect the two faces and extend therebetween. A tension strap is also optionally mounted on at least one of the faces. The strap can be connected to at least two tabs of the flat plate, and the tabs can be opposing such that they are not adjacent. For example, where there are four tabs, the strap may attach to two tabs that are diagonal from each other. The tension strap may be arched so that when the plate deforms, the tension strap straightens. In some embodiments there are two tension straps. In such, one strap may be on each face, and the straps are optionally perpendicular to each other. For instance, with four tabs, one strap may connect to two diagonal tabs while the other strap connects to the other two diagonal tabs. In that event, if the plate is deformed, along one diagonal the plate may expand while along another diagonal the plate may contract. Thus, as one strap expands and straightens, the other strap may contract and/or become more arched.

While the plate may include a single perforation, it may also include multiple perforations. For instance, the perforations may include multiple holes, multiple slots, or a combination of one or more holes and one or more slots. Optionally, the flat plate is connected to another flat plate that is substantially identical. The flat plates can be connected, but rotated relative thereto, so that the apertures in the first plate do not necessarily align with apertures in the second plate, even if tabs and/or nodes align in the two plates. For instance, the plates may have apertures that are symmetric along exactly two axes of symmetry, so that when rotated relative to each other, the axes of symmetry for the two plates are also rotated relative to each other.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope, nor are the drawings necessarily drawn to scale. The invention will be described and explained with additional specificity and detail through the use of the accompanying drawings in which.

DETAILED DESCRIPTION OF EXAMPLE EMBODIMENTS

Figure 1A:
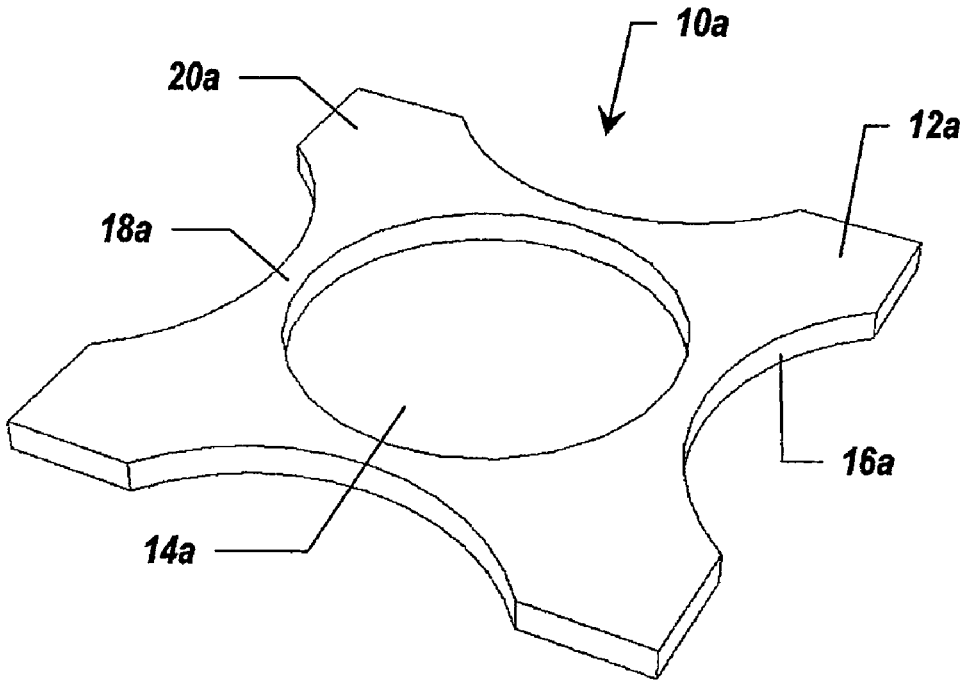
FIG. 1A illustrates a perspective view of a perforated plate seismic damper according to one embodiment of the present invention, the damper having perforations to focus shear and tension forces occurring during a seismic event on nodes within the damper.

Exemplary embodiments of the invention relate to a seismic damper which, when fixed to a structure, can absorb significant amounts of energy through deformation, thereby reducing the overall displacement and damage to a structure. A seismic damper of the system can include a single plate which includes fuse areas configured to deform as a structure experiences seismic accelerations, and which can accumulate such deformation through multiple cycles. In embodiments in which a single plate damper is used, the damper can be simply and efficiently fabricated at low cost, thereby also allowing the damper to be cost efficiently replaced after excessive deformation.

Reference will now be made to the drawings to describe various aspects of exemplary embodiments of the invention. It is understood that the drawings are diagrammatic and schematic representations of such exemplary embodiments, and are not limiting of the present invention. Accordingly, while the drawings illustrate an example scale of certain embodiments of the present invention, the drawings are not necessarily drawn to scale for all embodiments. No inference should therefore be drawn from the drawings as to the required dimensions of any invention or element, unless such dimension is recited in the appended claims. In the following description, numerous specific details are set forth in order to provide a thorough understanding of the present invention. It will be obvious, however, to one of ordinary skill in the art that the present invention may be practiced without these specific details.

FIGS. 1A-1D illustrate various views of an exemplary embodiment of a seismic damper 10*a* according to one embodiment of the present invention. In particular, FIGS. 1A-1D illustrate an exemplary seismic damper 10*a* which can absorb energy generated during a seismic event, and which may do so by stretching in a non-linear manner when a load reaches a threshold level, thereby limiting displacement of an associated support or bracing structure to non-linear displacement. In this manner, seismic accelerations may deform seismic damper 10*a*, such that non-linear deformation is substantially confined to seismic damper 10*a*, thereby reducing lateral displacement of an attached structure and possibly limiting inter-story drift.

As illustrated in FIGS. 1A-1D, seismic damper 10*a* can include, according to one exemplary embodiment, a plate 12*a* which can be configured to receive the seismic loading and deform in a non-linear manner. In the illustrated embodiment, plate 12*a* is generally square in shape, and has a thickness which is substantially less than the length of the sides of the square, although it will be appreciated that these dimensions are exemplary only and not limiting of the present invention. In fact, in other embodiments, plate 12*a* can have a variety of other shapes, including circular, rectangular, oval, triangular, hexagonal, or any other regular or irregular geometric shape.

In some embodiments, plate 12*a* can be configured to focus forces, such as tensile, compressive and/or shear forces, which can act on seismic damper 10*a*. For example, plate 12*a* may be constructed so as to concentrate any such forces primarily within specific, predetermined portions of plate 12*a*. Any suitable manner of focusing the forces to the specific, predetermined portions of plate 12*a* may be implemented. For example, and as illustrated in FIGS. 1A-1D, portions of plate 12*a* can be removed, such that a lesser area is provided within plate 12*a* for being acted upon by the associated forces. For instance, in the illustrated embodiment, an aperture 14*a* may be formed in seismic damper 10*a*. By having aperture 14*a* formed in seismic damper 10*a*, material is removed from plate 12*a* such that as a force is applied to seismic damper 10*a*, the forces are distributed over principally, or only, the un-removed portion of plate 12*a*. As discussed in more detail herein, as forces may be distributed unevenly over plate 12*a*, such forces may further be focused principally to interfaces between portions of plate 12*a* which are situated between the unevenly distributed forces.

Figure 1B:
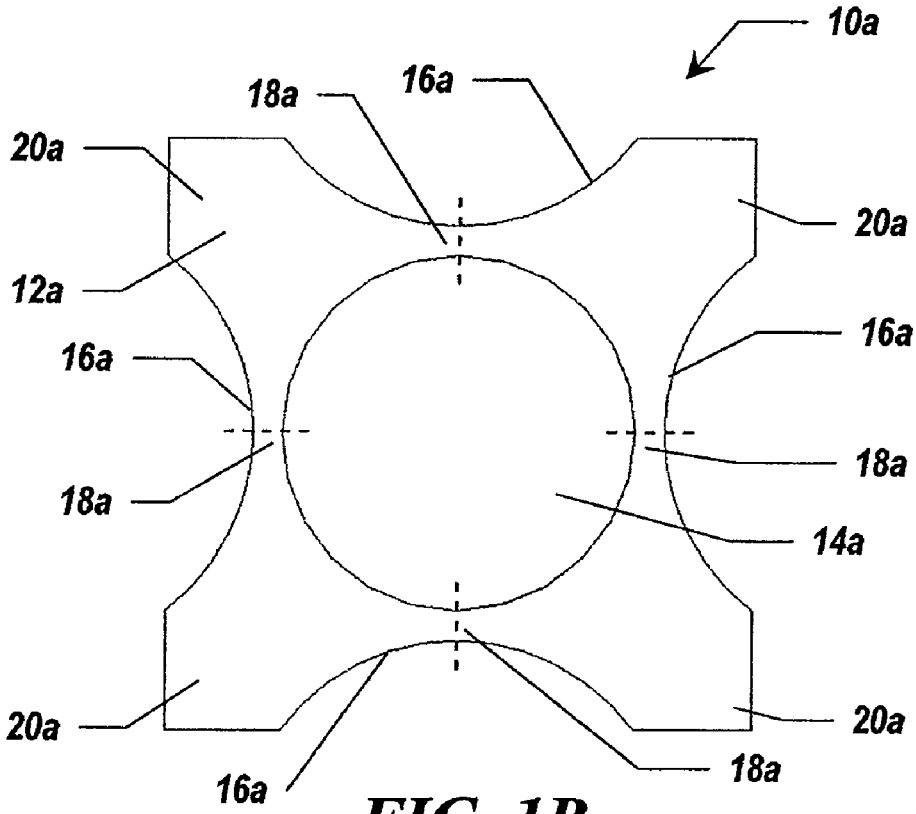
FIG. 1B illustrates a top view of the perforated plate seismic damper of FIG. 1A.
Figure 1C:
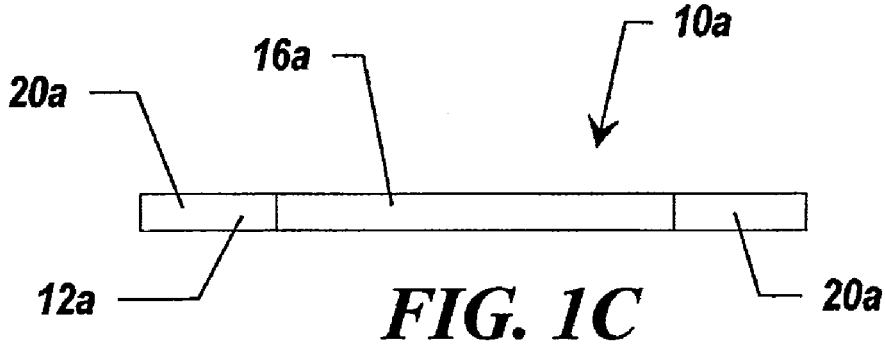
FIG. 1C illustrates a side view of the perforated plate seismic damper of FIGS. 1A and 1B.

As best illustrated in FIG. 1B, according to one embodiment of the invention, aperture 14*a* can have a substantially circular shape and may be substantially centered on plate 12*a*, although this arrangement is exemplary only. In other embodiments, for example, aperture 14*a* has other shapes (e.g., diamond, square, rectangle, octagonal, etc.) or placements (e.g., off-center). Moreover, in still other embodiments, more than one aperture may be formed in plate 12*a* and arranged such that the multiple apertures are centered or off-center relative to plate 12*a*.

Aperture 14*a* can be formed in plate 12*a* in any suitable manner, and no particular method for forming aperture 14*a* is to be considered limiting of the present invention. For example, plate 12*a* may be formed of a metal such as iron or steel. In such an exemplary embodiment, aperture 14*a* may be formed by machining plate 12*a* (e.g., drilling, milling, reaming, punching, cutting, slotting, broaching, grinding, etc.) or otherwise carving out aperture 14*a* in plate 12*a*. In other embodiments, however, aperture 14*a* may be formed substantially simultaneously with plate 12*a* such as by, for example, forming plate 12*a* with aperture 14*a* during a casting (e.g. die casting, sand casting, investment casting, etc.) or molding process.

To further allow seismic energy to be focused within seismic damper 10*a*, seismic damper 10*a* can include, in some example embodiments, one or more additional cut-outs that remove additional material from plate 12*a*. For example, in the illustrated embodiment of FIGS. 1A-1D, seismic damper 10*a* can include four cut-outs 16*a* which are each formed or machined along an outside edge of plate 12*a*. Cut-outs 16*a* can also be formed in any suitable manner, including any manner discussed herein for forming aperture 14*a*.

Cut-outs 16*a* may be adapted to have any of a variety of different shapes and configurations. In the illustrated embodiment, for example, cut-outs 16*a* have a substantially constant curvature, thereby forming an arc along each of the four sides of plate 12*a*. In other embodiments, however, exemplary cut-outs may have only straight edges and sharp corners, or may have other configurations. For example, exemplary cut-outs may take the form of any portion of a circle, triangle, square, rectangle, trapezoid, rhombus, hexagon, or virtually any other simple, complex, regular, irregular, symmetrical, or non-symmetrical geometric shape. Cut-outs 16*a* may also, by way of example and not limitation, be centered along the sides of plate 12*a*, although this feature is not necessary. For example, in alternative embodiments, a cut-out may be formed at a corner of a plate forming a seismic damper and/or multiple cut-outs may be formed on one or more side of such a plate.

Cut-outs 16*a* may also have any of a variety of sizes. For example, while the embodiment illustrated in FIGS. 1A-1D illustrates that the length of cut-outs 16*a* along the may be about equal to the diameter of circular aperture 14*a*, it will be appreciated in light of the disclosure herein that this feature is exemplary only. In particular, in other embodiments, cut-outs 16*a* may have lengths larger or smaller than the diameter, major axis, minor axis or length of one or more apertures within plate 12*a*. In other embodiments, a cut-out or aperture may be excluded. For example, in one embodiment, cut-outs are formed which extend substantially towards a middle of the flat plate, such that no aperture is also formed in the plate.

Figure 1D:
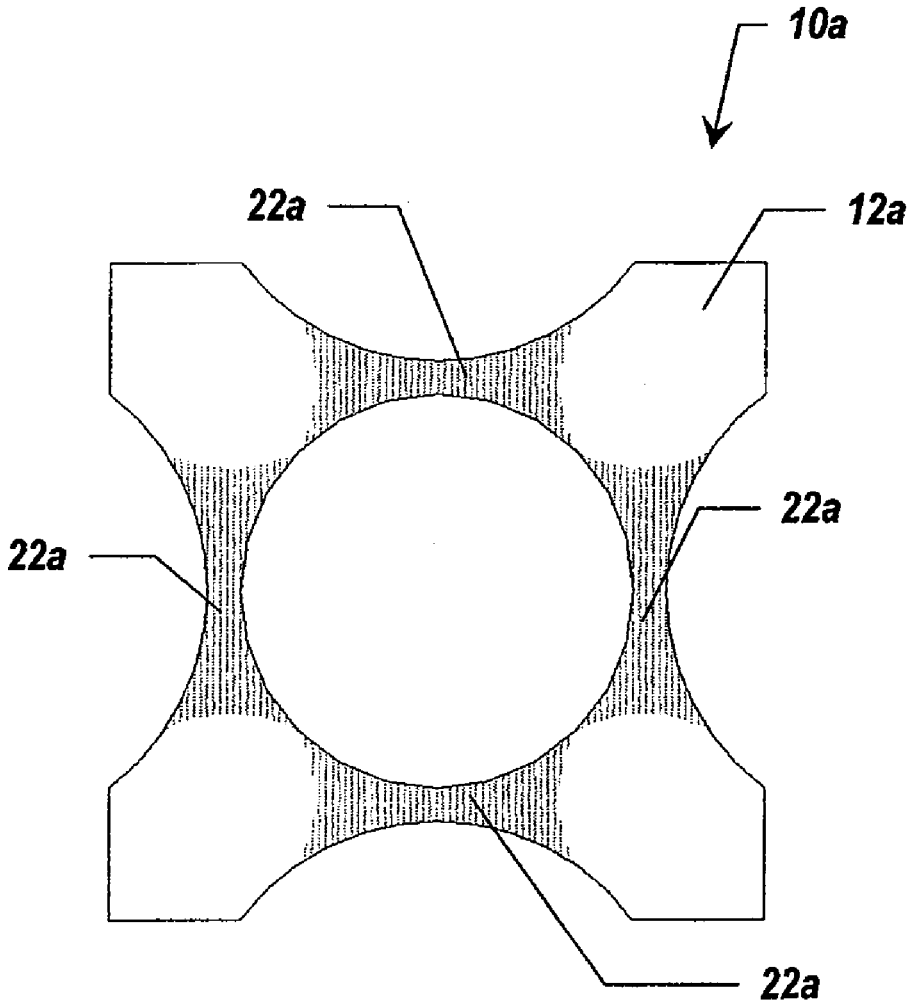
FIG. 1D illustrates a top view of the perforated plate seismic damper of FIG. 1A, further illustrating the nodes on which shear and tension forces are focused.

As noted above, the four cut-outs 16*a* are, in the illustrated embodiment, each substantially centered along a respective side of square plate 12*a*, thereby forming four tabs 20*a*, which are, in the illustrated embodiment, separated by the dashed lines. In this manner, each of tabs 20*a* may be aligned with, and include, a corner of plate 12*a*. Additionally, as best illustrated in FIGS. 1B and 1D, cut-outs 16*a* can form continuous arches on the sides of plate 12*a*, thereby causing plate 12*a* to neck down towards aperture 14*a*. For example, plate 12*a* can neck down to form four nodes 18*a* which are centered on the intersection between tabs 20*a*, at the point where plate 12*a* necks down.

Nodes 18*a* can be fuse points situated between, and connecting each of tabs 20*a*. Furthermore, in some cases, such as where plate 12*a* necks down at or near nodes 18*a*, nodes 18*a* can focus seismic energy which acts on seismic damper 10*a* and/or an associated support or bracing structure attached to seismic damper 10*a*.

Figure 2:
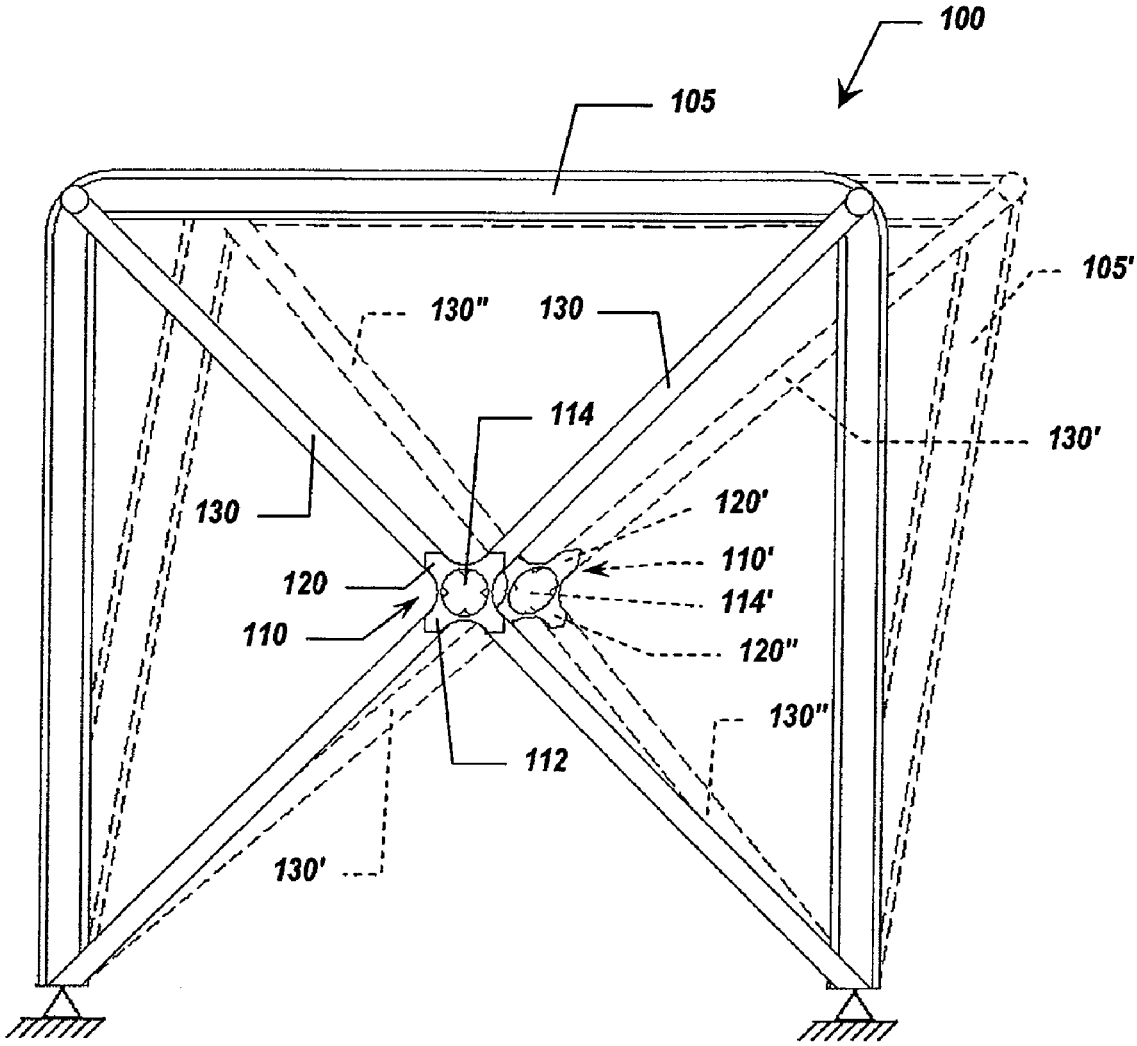
FIG. 2 illustrates a brace and support system having cross members on which a perforated plate seismic damper is implemented.

For example, with reference now to FIG. 2 a plurality of tabs 120 can be configured to be attached to one or more bracing members 130 of a brace system 105 within a seismic damping brace system. In the embodiment illustrated in FIG. 2, for instance, bracing members 130 are diagonal, cross-members which are each angularly offset from each other at about equal ninety degree intervals. In the illustrated embodiment, each cross-member can also be aligned with, and/or connected to, one of tabs 120 of seismic damper 110, thereby installing seismic damper 110 in about the center of the cross-members of the bracing system.

As a seismic or other event causes the support system to move laterally, brace system 105 can move laterally to a position such as that illustrated in FIG. 2 as brace system 105'. As will be appreciated, in the illustrated embodiment, brace system 105 may be an equilibrium position while brace system 105' may be a position which requires some external forces.

As brace system 105 moves laterally to the position of brace system 105', cross-members 130 can be placed in tension and/or compression. For instance, in brace system 105', the bracing cross-members 130' can be stretched and placed in tension as, brace system 105' moves laterally in one direction, thereby elongating brace members 130'. In contrast, bracing cross-members 130" can be placed under compression, thereby reducing the length of brace members 130' from their equilibrium length in brace system 105. It will also be appreciated in view of the disclosure herein that a force which causes brace system 105 to move to position 105' may also oscillate. In such a manner, brace system 105 may move laterally in each direction (illustrated as left and right in FIG. 2). Thus, cross-members 130 may alternatively move from tension to compression.

As brace members 130 undergo tension and/or compression, seismic damper 110 can also be stressed in a tensile and/or compressive manner. For example, in the illustrated embodiment, a tab 120' of seismic damper 110' which is connected to a support member 130' under tension may also be subjected to tensile forces. In a similar manner, if a tab 120" of seismic damper 110' is connected to a support member 130" under compression, the corresponding tabs 120" may also be placed under compression.

As each tab 120 can be placed in compression or tension, as dictated by the associated support member to which it is attached, at a particular instant of time, one or more of tabs 120 (e.g., tabs 120') can be in tension while one or more other of tabs 120 (e.g., tabs 120") can be in compression. As a result, seismic damper 110 can be placed under both compressive and tensile stresses at any particular instant. Further, as noted above, as brace system 105 to which seismic damper 10*a* is attached oscillates, these compressive and tensile stresses can switch directions and magnitudes. Thus, while braces 130' and tabs 120', and braces 130" and tabs 120', are illustrated as being under tension and compression, respectively, when brace system 105 sways in the opposite direction, the tensile and compressive nature of such stresses can be reversed.

A seismic event may induce displacement within a structure such as seismic damping brace system 100. In small seismic events, the displacement may be largely linear, whereas a large seismic event can induce non-linear displacement within a structure and/or within seismic damping brace system 100. Such non-linear displacement can cause significant damage, however, if passed on to brace system 105. Accordingly, to reduce, and possibly eliminate, the non-linear movement of brace system 105, tensile and compressive stresses, and their associated shear stresses, may be concentrated in seismic plate 112, rather than in brace system 105, including cross-members 130. In particular, and as described herein, a seismic damper such as seismic damper 110, may include a plurality of nodes which have a reduced and possibly necked area which acts as fuse points between a plurality of tabs. As the shear, compressive, and/or tensile forces act on the plate, these forces can then be focused at the nodes, which may substantially confine non-linear strains therein, thereby allowing an attached structure, such as brace system 105 to move linearly. Thus, nodes within plate 112 can absorb significant amounts of energy to reduce the lateral displacement of brace system 105.

Moreover, as the seismic forces or other forces cause brace system 105 to move back-and-forth, diagonal cross-members 130 may experience a pattern of extension along one diagonal and contraction along the other. A similar pattern is transferred to seismic damper 110 where tabs 120 experience patterns of expansion and contraction. When seismic damper 110 is loaded beyond its elastic capacity, seismic damper 110 begins to deform in a non-elastic manner, thereby absorbing energy. This energy and deformation can also be focused on nodes within plate 112 which have, in one example, a reduced area.

In particular, as tensile and shear forces act on nodes such as nodes 18*a* in FIG. 1B, the area of the nodes can deform. Further, as brace system 105 moves in the opposite direction, shear forces acting on nodes can reverse direction to further deform the material. Moreover, as the shear forces reverse direction, the shear forces can act in opposite planes, thereby allowing for multiple cycles of loading.

Returning briefly to FIGS. 1B and 1D, an exemplary seismic damper 10*a* is illustrated in which nodes 18*a* are illustrated. In the illustrated embodiment, each of nodes 18*a* has an associated fuse area 22*a* which represents the portions of plate 12*a* which can undergo the bulk of non-linear displacement and non-elastic deformation which plate 12*a* experiences during a major seismic event. Thus, forces acting on seismic damper 10*a* can be substantially focused within fuse areas 22*a*, such that fuse areas 22*a* can absorb significant amounts of energy that would otherwise extend to an attached brace system, thereby allowing the attached brace system to instead undergo largely or wholly linear displacement, and thereby reducing, and possibly eliminating, damage associated with non-linear displacement.

In light of the disclosure herein, it will be appreciated that seismic damper 10*a* can, accordingly, accumulate deformation to allow the damper to perform through multiple cycles. Multiple cycles may occur, for example, in a single, major seismic event and/or in multiple major or minor seismic events. Following such an event or series of events, seismic damper 10*a* can be replaced.

Moreover, because seismic damper 10 can, in some example embodiments, comprise a single flat plate 12*a* having one or more apertures 14*a* and/or cut-outs 16*a* formed therein, seismic damper 10*a* can be easily fabricated and installed. For instance, flat plate 12*a* can be formed of a suitable metal, alloy, polymer, ceramic, composite, or other material. For example, flat plate 12*a* may be formed of a solid or hollow plate of steel. Such a plate can thus be manufactured at low cost, thereby allowing seismic damper 10*a* to be installed on any class of braced building to provide high-performance structural damping. Moreover, as tabs 20*a* can be connected to support braces, seismic damper 10*a* can be installed on new construction, and/or can be used to retrofit and rehabilitate existing construction, or can replace an existing seismic damper which has experienced excessive nodal deformations.

Although FIGS. 1A-1D and FIG. 2 illustrate similar seismic dampers that have a generally square configuration with a circular, central aperture and various arched cut-outs on the sides of the square plate, it will be appreciated that these features, collectively and individually, are merely representative of the present invention and not limiting thereof. Indeed, various other configurations are suitable and contemplated.

For example, in other embodiments, a brace system may have braces which are not equally offset at ninety degree angles as is illustrated in FIG. 2, such that a seismic damper (e.g., seismic damper 10*c* of FIG. 4) having a rectangular, rather than square, configuration would be desirable. In still other embodiments, a seismic damper may be attached to three brace members, such that a triangular seismic damper (e.g., seismic damper 10*d* of FIG. 5) can be used. Moreover, in some embodiments, a single central aperture may be eliminated and/or replaced by a plurality of apertures which are offset in a regular or irregular pattern. Similarly, one or more cut-outs may be formed on the sides or corners of a plate in a regular pattern, or one or more sides have a different pattern of cut-outs.

Accordingly, it will be appreciated that the dimensions and configuration of a seismic damper according to aspects of the present invention can be varied as necessary for any particular structural brace system, and for energy absorption to be provided according to a variety of different considerations. For instance, in some embodiments, seismic damper 10*a* may be about twenty inches by twenty inches. Moreover, in additional exemplary embodiments, central aperture 14*a* may be about twelve inches in diameter, cut-outs 16*a* have lengths of about twelve inches, and/or cut-outs 16*a* having a depth of about three inches. Moreover, plate 12*a* can have a thickness between one-half and five inches. It will be appreciated, however, that these dimensions are exemplary only and that in other embodiments, plate 12*a*, aperture 14*a* and cut-outs 16*a* may have other dimensions, sizes, shapes, or configurations.

Now turning to FIGS. 3A-3D, an exemplary embodiment of a seismic damper 10*b* is illustrated according to an alternative embodiment of the present invention, and can be configured to absorb energy so as to confine a corresponding brace system to displacement in substantially only a linear manner.

In particular, FIGS. 3A-3D illustrate an exemplary seismic damper 10*b* which can absorb energy generated during a seismic event by stretching in a non-linear manner when a load reaches a threshold level, thereby largely limiting displacement of an associated support or bracing structure to linear displacement. In this manner, seismic accelerations deform seismic damper 10*b*, such that non-linear deformation is substantially confined to seismic damper 10*b*, thereby reducing or eliminating non-linear displacement, reducing lateral displacement of the structure, and limiting inter-story drift.

As illustrated in FIGS. 3A-3D, a seismic damper 10*b* can include, according to one exemplary embodiment, a plate 12*b* which can be configured to receive the seismic loading and deform in a non-linear manner. In the illustrated embodiment, for example, plate 12*b* is generally square in shape, and has a thickness which is substantially less than the length of the sides of the square, although it will be appreciated that these dimensions are exemplary only and not limiting of the present invention. In fact, in other embodiments, plate 12*b* can have a variety of other shapes, including circular, oval, triangular, rectangle, hexagonal, octagonal, or any other regular or irregular geometric shape.

In some embodiments, plate 12*b* can be configured to focus forces (e.g., tensile, compressive, and/or shear forces) which may act on seismic damper 10*b* so as to substantially concentrate the forces within specific, predetermined portions of plate 12*b*. To focus any such forces, portions of plate 12*b* can be removed, such that a lesser area is provided within plate 12*b* for being acted upon by the associated forces. For example, in the illustrated embodiment, seismic damper 10*b* includes an aperture 14*b* which is formed in plate 12*b* of seismic damper 10*b*. By having aperture 14*b* formed in seismic damper 10*b*, material is removed from plate 12*b* such that as a force is applied to seismic damper 10*b*, the forces are distributed over the un-removed portion of plate 12*b* which has not been removed. In other words, by removing the material to form aperture 14*b*, a force applied to seismic damper 10*b* is distributed over a smaller area.

Moreover, adjacent aperture 14*b* plate 12*b* may include a plurality of nodes 18*b* at which forces are focused. As discussed herein, nodes 18*b* can act as fuse points between various tabs 20*b* which can be placed under different forces. As different forces act on tabs 20*b*, forces can further be focused at nodes 18*b*.

In the embodiment illustrated in FIGS. 3A-3D, aperture 14*b* is of a substantially diamond-shaped configuration, with rounded corners, and is substantially centered on plate 12*b* with the rounded corners of aperture 14*b* being centered along the four sides of plate 12*b*. It will be appreciated, however, that this arrangement is exemplary only. In other embodiments, for example, aperture 14*b* has other shapes (e.g., circular, square, rectangle, octagonal, sharp corners, etc.) or configurations (e.g., off-center, corners aligned with corners of plate 12*b*, etc.). Moreover, in still other embodiments, more than one aperture may be formed in plate 12*b*.

To further allow seismic energy to be focused within seismic damper 10*b*, seismic damper 10*b* can include, in some example embodiments, one or more additional cut-outs which remove additional material from plate 12*b*. For example, in the illustrated embodiment of FIGS. 3A-3D, seismic damper 10*b* can include four cut-outs 16*b*, one cut-out 16*b* being formed or machined on each outside edge of plate 12*b*. Cut-outs 16*b* can also have any of a variety of shapes and configurations. In the illustrated embodiment, for example, cut-outs 16*b* are about semi-circular in shape, thereby forming an arc along each of the four sides of plate 12*b*. Cut-outs 16*b* may also, by way of example and not limitation, be centered along the sides of plate 12*b*, although this feature is not necessary. Further, in alternative embodiments, multiple cut-outs may be formed on each side of plate 12*b* and/or be aligned in the corners of plate 12*b*.

Cut-outs 16*b* may also have any of a variety of different sizes. For example, semi-circular cut-outs 16*b* can have a length along the side of plate 12*b* which is about half the distance across aperture 14*b* (i.e., from point-to-point in aperture 14*b*). It will be appreciated in light of the disclosure herein, however, that such an arrangement is exemplary only. For example, in other embodiments, cut-outs 16*b* may have lengths and/or diameters which are more or less than half the distance across aperture 14*b*, or which is about the same size as, or larger than, the distance across aperture 14*b* within plate 12*b*.

In the illustrated embodiment, cut-outs 16*b* are each substantially centered along a respective side of square plate 12*b*, thereby forming four tabs 20*b*, which are, in the illustrated embodiment, separated by the dashed lines. In this manner, each of tabs 20*b* can be aligned with, and include, a corner of plate 12*b*. Additionally, cut-outs 16*b* can form continuous arches on the sides of plate 12*b*, which cause plate 12*b* to neck down towards aperture 14*b*. For example, as illustrated in FIGS. 3B and 3D, plate 12*b* can neck down to form four nodes 18*b* which are centered on the intersection between tabs 20*b*, and at about the point where plate 12*b* necks down to the smallest distance between cut-outs 16*b* and aperture 14*b*.

As described previously with respect to tabs 120 in FIG. 2, tabs 20*b* can, in some embodiments, be configured to attach to one or more braces in a corresponding brace system. Such an attachment may be made by mechanical fasteners (e.g., screws, rivets, nails, clamps, staples, etc.) which are integral with, or separable from, tabs 20*b*, by welding or adhesives, or by the use of any other suitable attachment means. In this manner, as the structure to which seismic damper 10*b* is attached undergoes seismic accelerations and moves laterally, seismic damper 10*b* can absorb substantial amounts of energy within nodes 18*b*, thereby possibly confining non-linear displacement to plate 12*b* and allowing the attached brace system to experience only linear displacement.

Figure 3A:
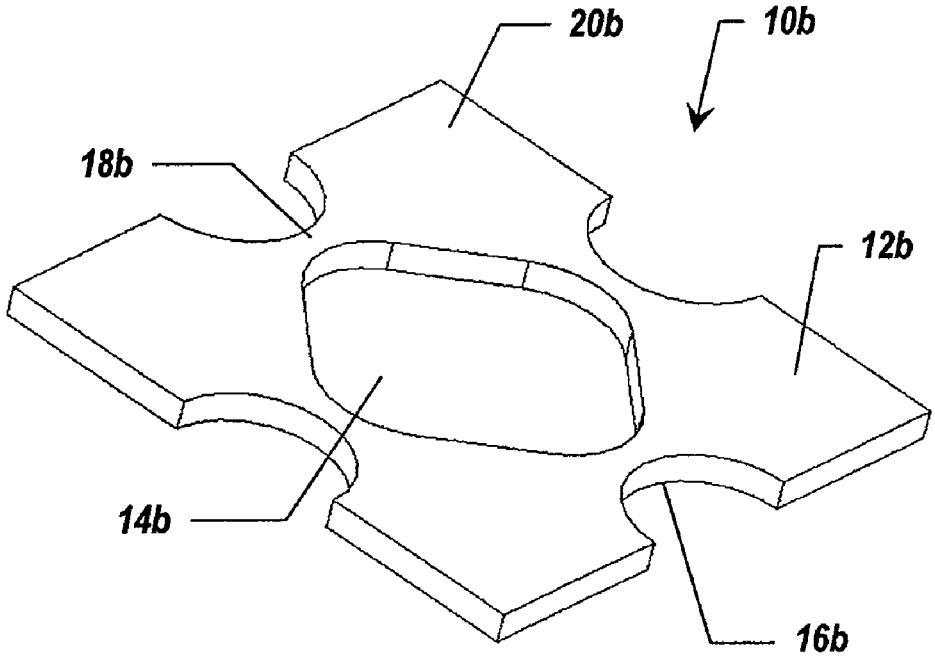
FIG. 3A illustrates a perforated plate seismic damper according to an alternative embodiment of the present invention, the damper having an alternative configuration of perforations for focusing forces on nodes within the damper.
Figure 3B:
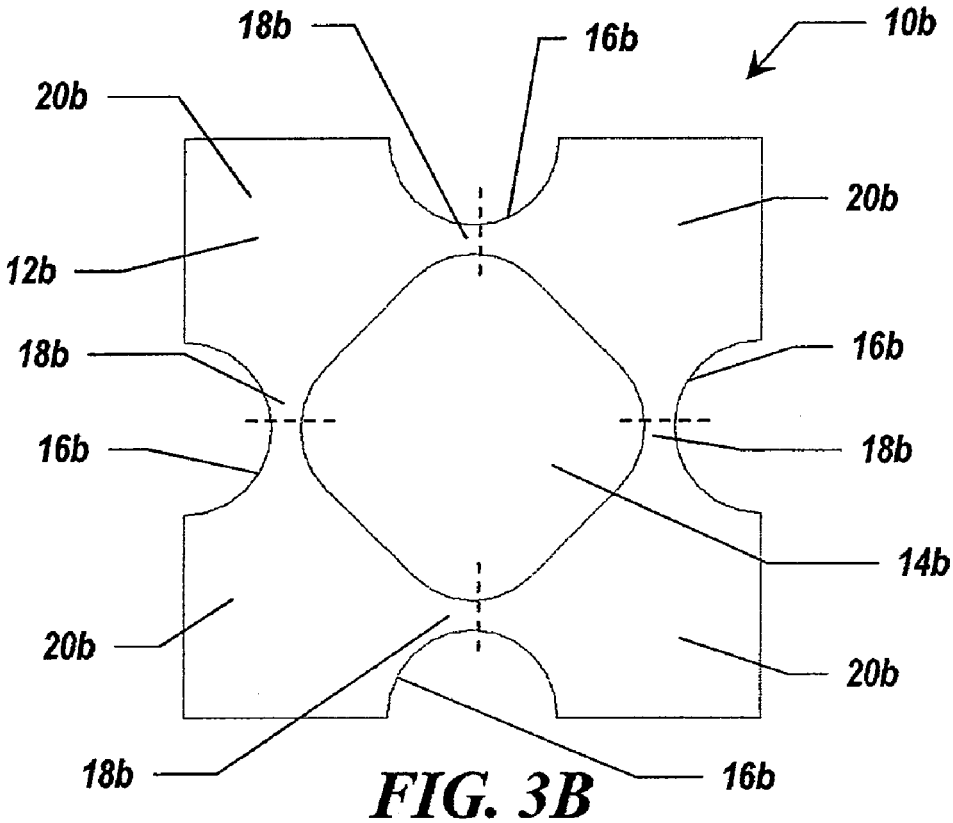
FIG. 3B illustrates a top view of the perforated plate seismic damper of FIG. 3A.
Figure 3C:
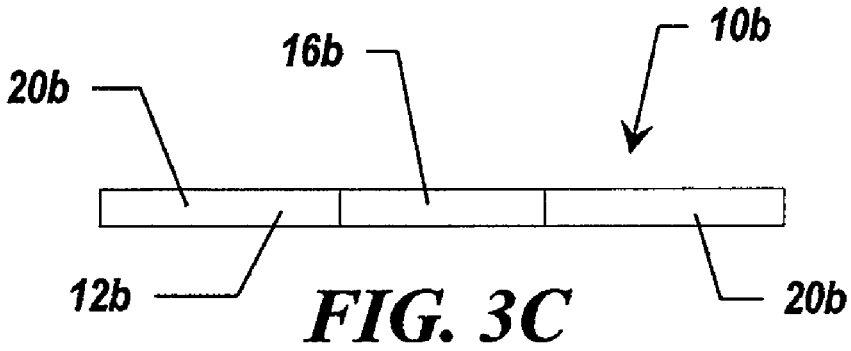
FIG. 3C illustrates a side view of the perforated plate seismic damper of FIGS. 3A and 3B.
Figure 3D:
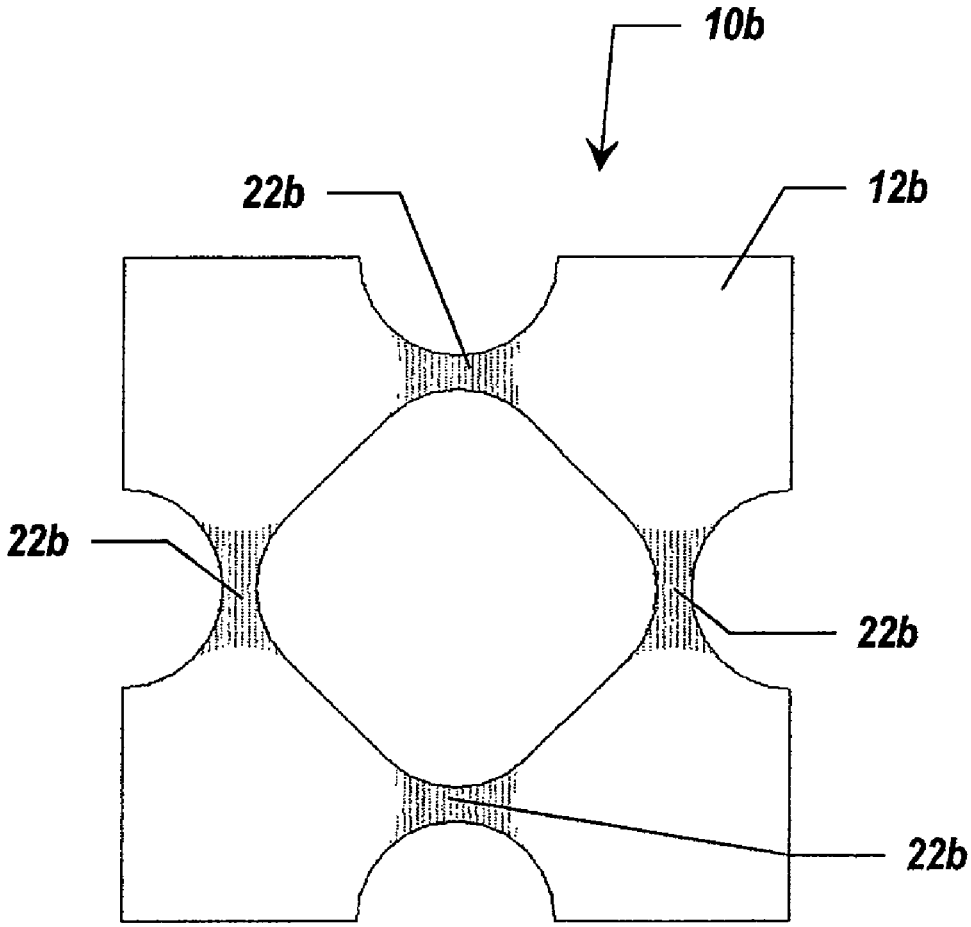
FIG. 3D illustrates a top view of the perforated plate seismic damper of FIG. 3A, further illustrating the nodes on which shear and tension forces are focused.

As illustrated in FIG. 3D, nodes 18*b* can have associated fuse areas 22*b* in which stresses caused by the seismic acceleration are concentrated. Such fuse areas 22*b* can undergo non-elastic deformation during a seismic event, thereby absorbing significant amounts of energy such that an attached brace system may be displaced in only a linear manner, thereby reducing, and possibly eliminating, damage associated with non-linear displacement.

In the embodiment illustrated in FIGS. 3B and 3D, it can be seen that fuse areas 22*b* may have a generally hour-glass shape that is centered on a corner of diamond-shaped aperture 14*b*, and may be sized such that the length of fuse areas 22*b* is less than a length of cut-outs 16*b*. It should be appreciated that this is exemplary only. For example, in FIGS. 1B and 1D, a fuse area 22*a* may also have a generally hour-glass shape and have a length less than a length of cut-out 16*a*, but may not be centered on corners of a diamond. In other embodiments, the shape of the fuse area in which stresses and/or strains are concentrated may take other shapes, and such shapes may be dependent on the dimensions and shapes of the features of an associated seismic damper and/or the material used to form the seismic damper.

Figure 4:
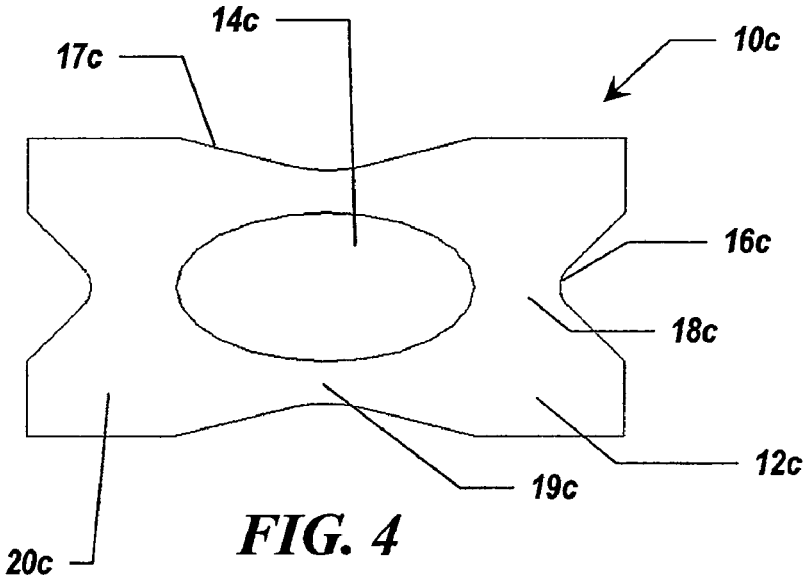
FIGS. 4-6 illustrate other example configurations of perforated plate seismic dampers according to other aspects of the present invention.
Figure 5:
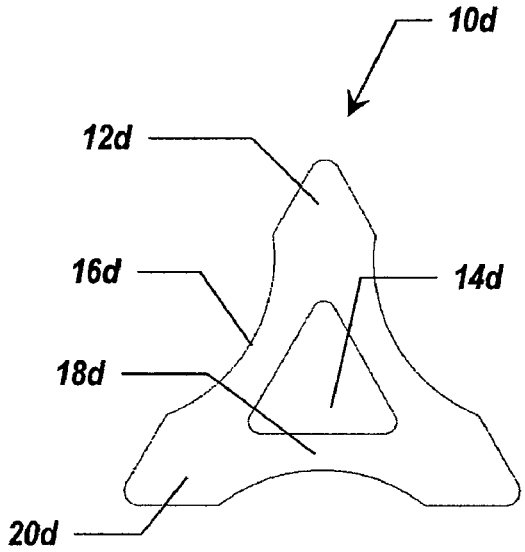
Figure 6:
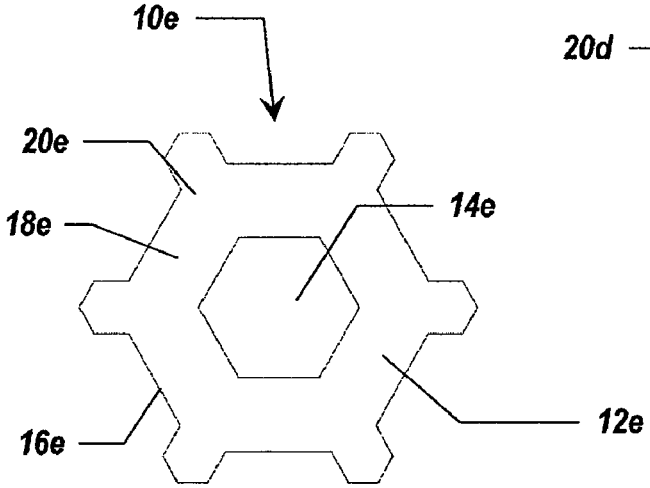

For example, FIGS. 4-6 illustrate various other example embodiments of exemplary seismic dampers which may be used to attach to various alternative brace structures and/or have fuse areas of different sizes, shapes, locations and/or configurations. In FIG. 4, for example, a seismic damper 10*c* is made from a substantially flat plate 12*c* that has a generally rectangular configuration. Such a shape may be desirable where, for example, seismic damper 10*c* is to be attached to four cross-braces of a support structure which are not equally offset at ninety-degrees. For example, seismic damper 10*c* may be attached to cross-members that are alternatively offset at one hundred-twenty degrees and sixty degrees, although any other unequal offset may also be accounted for.

In the illustrated embodiment, flat plate 12*c* may include one or more apertures 14*c* and/or cut-outs 16*c*, 17*c*. In the illustrated embodiment, for instance, an oval aperture 14*c* is formed in flat plate 12*c* and substantially centered therein. As disclosed herein, aperture 14*c* can also include any other shape, such as a circle or rectangle, and/or may optionally be off-center relative to rectangular plate 12*c*. Furthermore, as illustrated in FIG. 4, it is not necessary that cut-outs 16*c*, 17*c* each have the same shape and/or configuration. For instance, in the illustrated embodiment, cut-outs 16*c* are formed along the shorter edges of rectangular plate 12*c*, and are generally shaped as an acute triangle. In contrast, cut-outs 17*c* are formed along the longer edges of rectangular plate 12*c* and are generally shaped as an obtuse triangle.

By varying the size and/or shape of cut-outs 16*c*, 17*c*, it will also be appreciated that the size and/or shape of nodes 18*c*, 19*c*, as well as the fuse areas associated therewith, can also be different. For example, nodes 18*c* may have more distance between cut-outs 16*c* and aperture 14*c*, while nodes 19*c* may have a relatively shorter distance between cut-outs 17*c* and aperture 14*c*. However, the length of nodes 19*c* may also be corresponding larger than the length of nodes 18*c*, although this is exemplary only. In other embodiments, the distance between cut-outs 16*c*, 17*c* and aperture 14*c* may be about the same.

As further illustrated, seismic damper 10*c* can also include a tab 20*c* in each corner of rectangular plate 12*c*. The tab 20*c* can be defined by the cut-outs 16*c*, 17*c* and aperture 14*c*, and the tabs 20*c* can intersect at a line centered in nodes 18*c*, 19*c*. Further, in the illustrated embodiment, it can be seen that while each tab 20*c* may optionally have about the same shape or mirrored shape of the other tabs 20*c*, it is not necessary that tabs 20*c* be symmetrical. For instance, the length of tab 20*c* to cut-outs 16*c*, 17*c* may vary, thereby forming asymmetrical tabs 20*c*.

Now turning to FIG. 5, another example embodiment of a seismic damper 10*d* is illustrated. In the illustrated embodiment, seismic damper 10*d* is formed of a substantially flat plate 12*d* and can have a generally triangular shape. Specifically, in the illustrated embodiment, seismic damper 10*d* has triangular shape with rounded corners and rounded cut-outs 16*d* along each edge of flat plate 12*d*, although in other embodiments, the corners of flat plate 12*d* need not be rounded and/or cut-outs 16*d* may be omitted, have flat edges, or be otherwise shaped.

As also illustrated, in the example embodiment, flat plate 12*d* also can have an optional aperture 14*d* formed therein. In this embodiment, aperture 14*d* also has a generally triangular configuration and is aligned with the triangular configuration of flat plate 12*d*, although this is also exemplary and can be varied in any manner described herein. Three tabs 20*d* can also thusly be formed at or near each corner of flat plate 12*c* and can join at or near nodes 18*d*. As with the nodes in the other seismic dampers herein, nodes 18*d* may be locations within flat plate 12*d* at which stresses are concentrated to deform flat plate 12*d*. As flat plate 12*d* may be attached to a structural member which is subjected to seismic of other events, the concentration of stresses in nodes 18*d* can thus largely confine non-linear displacement and non-elastic deformation to flat plate 12*d*, and allow the attached structural member to undergo substantially only linear displacement.

Seismic damper 10*d* can be useful for a number of different applications. One application, for instance, is in connection with a structural member which has three joining cross-members. In such a system, each tab 20*d* can be connected to a respective cross-member and absorb the tensile, compressive, and/or shear forces applied thereto.

In view of the disclosure herein, it should be appreciated that a seismic damper can be constructed according to the present invention to attach to structural members and diagonal cross-members of virtually any size, shape, or configuration. For instance, FIG. 6 illustrates another example embodiment of a seismic damper 10*e* constructed for application in a structural support having six joining cross-members. In the illustrated embodiment, seismic damper 10*e* is formed from a flat plate having a substantially hexagonal shape.

Flat plate 10*e* can thus also include one or more optional apertures 14*e* of any suitable shape. For instance, aperture can be substantially circular, triangular, square, or elliptical, or may be substantially hexagonal as illustrated. Furthermore, although the illustrated embodiment illustrates substantially straight edges on flat plate 12*e* and aperture 14*e*, it will be appreciated that either or both of flat plate 12*e* and aperture 14*e* may have rounded or curved edges as may be desirable to, for example, reduce stress concentrations at discrete locations.

As further illustrated, seismic damper 10*e* can also include a plurality of cut-outs 16*e* centered along one or all of the edges of flat plate 12*e*. In this embodiment, cut-outs 16*e* form a portion of a trapezoid, and further define, in connection with aperture 14*e*, six tabs 20*e* and six nodes 18*e*, which are centered at the intersection of tabs 20*e*, thereby providing a generally wagon-wheel shape to seismic damper 10*e*. In the illustrated embodiment, and in contrast to some other embodiments disclosed herein, it can be seen that nodes 18*e* can have a generally constant width across a substantial length of node 18*e*, although this is exemplary only. In other embodiments, such as those others disclosed herein, a node can neck down and have a width that varies across substantially its entire length.

Figure 7A:
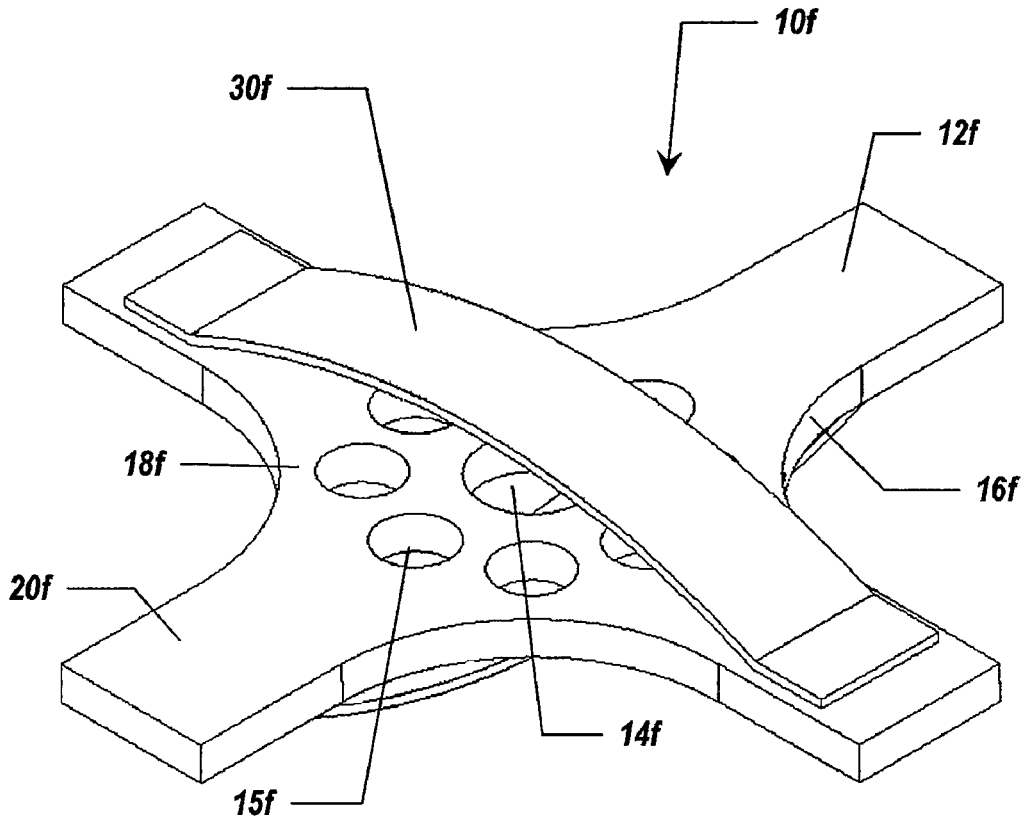
FIG. 7A illustrates a perspective view of a seismic damper according to another embodiment of the present invention, and which includes a pair of tension straps.
Figure 7B:
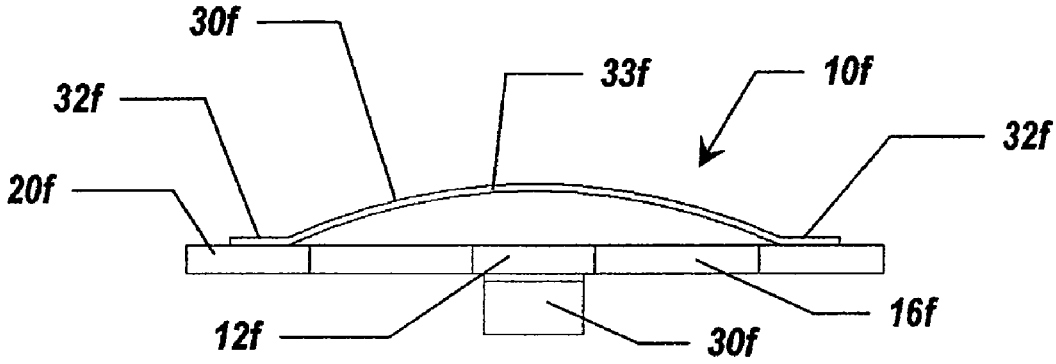
FIG. 7B illustrates a side view of the seismic damper of FIG. 7A.
Figure 7C:
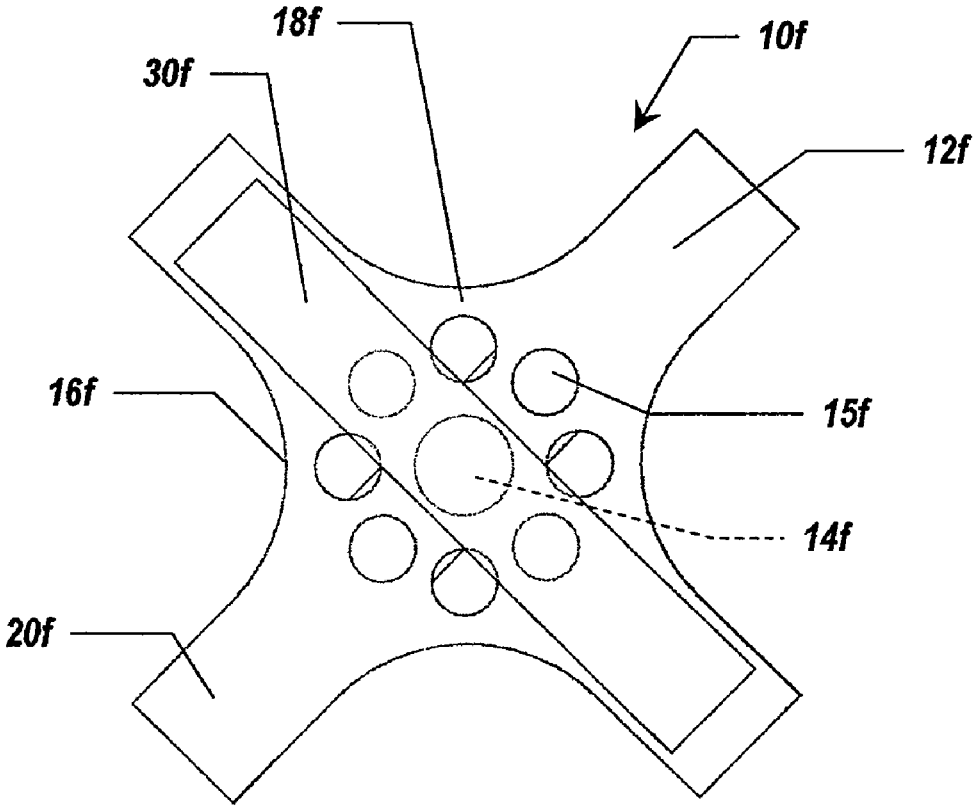
FIG. 7C illustrates a top vie of the seismic damper of FIG. 7A.

FIGS. 7A-7C illustrate yet another example embodiment of a seismic damper according to embodiments of the present invention, in which a strap 30*f* can be attached to at least one side of plate 12*f*. More particularly, in the illustrated embodiment shown best in FIGS. 7A and 7B, a strap 30*f* is attached to each of the opposing surfaces of plate 12*f*. While the illustrated embodiment illustrates the straps 30*f* as being attached to the top and bottom surfaces of plate 12*f*, it will be appreciated that this orientation is exemplary only and that plate 12*f* could be oriented such that straps 30*f* are attached to a top surface, bottom surface, left surface, right surface, front surface, back surface, and/or any other arbitrarily defined surface.

In one embodiment, straps 30*f* can be formed of a thin metal (e.g., steel, aluminum, etc.) and attached to two tabs 20*f* of plate 12*f*. In this particular exemplary embodiment, plate 12*f* includes four tabs 20*f*, and a strap 30*f* on the top surface attaches to two diagonally opposed tabs 20*f*, while the strap 30*f* on the bottom surface also attaches to two diagonally opposed tabs 20*f*. Thus, the straps 30*f* can attach to attach between two tabs 20*f* that are not adjacent to each other, but which are separated by at least one tab 20*f* and, in this embodiment, two nodes 18*f*. Of course, a strap 30*f* could also be attached to two adjacent tabs, between nodes rather than tabs, between a node and a tab, or in any other suitable manner.

The straps 30*f* may be connected to plate 12*f* in any suitable manner as will be appreciated by one of ordinary skill in the art in view of the disclosure herein. For example, in the embodiment best illustrated in FIG. 7B, straps 30*f* include a connection portion 32*f* at each end of strap 30*f* to facilitate connection of strap 30*f* to plate 12*f*. For instance, in this embodiment, connection portion 32*f* is substantially flat and lies along the surface of plate 12*f*, to provide a surface along which strap 30*f* can easily be connected by welding, soldering, brazing, by using mechanical fasteners, or in any other suitable manner.

In this embodiment, and between the connection portions 32*f*, strap also includes an arched portion 33*f*. In one aspect, arched portion 33*f* provides additional strength to seismic damper 10*f*, particularly at the point where seismic damper 10*f* would otherwise be near failure. For example, as described previously, including at least in the discussion related to FIG. 2, a seismic damper such as seismic damper 10*f* may be attached to a support system having cross-braces. As a seismic or other force is applied to those braces, one brace may experience tension and expand/lengthen, while the other brace undergoes compression and shortens/contracts.

When the tabs 20*f* which are connected to strap 30*f* undergo tension and expand, they likewise can cause strap 30*f* to expand. This expansion in strap 30*f* can thus cause arched portion 33*f* to lengthen, thereby reducing the amount of arch. In this manner, tension can cause the strap 30*f* to straighten. In general, strap 30*f* may provide the greatest resistance to the tensile forces on tabs 20*f* when strap 30*f* has undergone sufficient tension and elongation such that it has completely straightened out, or almost completely straightened out. This may also be pre-calculated. For example, when the plate 12*f* has elongated to a pre-calculated elongation length, straps 30*f* may then be almost completely straight, and can also thus begin to take a significant amount of load away from the plate 12*f*. This pre-calculated elongation length may, or may not, generally correspond to an elongation length at which failure of plate 12*f* is expected. In one embodiment, therefore, a strap 30*f* may straighten to provide its greatest absorption of energy when plate 12*f* has undergone a large amount of deformation and elongation, and is near failure. In either event, however, the straightening of the straps 30*f* can dissipate additional energy above and beyond what is performed by plate 12*f* alone.

As further discussed herein, often the tensile and compressive loading is cyclical in nature, such that while a strap 30*f* may at one point in a cycle undergo tension and elongate, in another point in the cycle the same strap 30*f* may undergo compression and contract. With the cyclical loading of plate 12*f*, the tabs 20*f* also undergo corresponding cycles of tension and compression.

In one embodiment, therefore, straps 30*f* can be configured to act along each of the different loading axes. For instance, in the illustrated embodiment a strap 30*f* is connected to plate 12*f* along the top surface of plate 12*f* in one diagonal direction and along one loading axis, while a second strap 30*f* is connected to plate 12*f* along the bottom surface of plate 12*f* in a different diagonal direction and along a different loading axis. In this exemplary case, the diagonal directions and loading axes are perpendicular, and the straps 30*f* therefore extend in respective directions that are also perpendicular to one another.

In this manner, regardless of the loading axis of plate 12*f*, straps 30*f* can be utilized to take some of the load away from plate 12*f*, and can be particularly useful when dissipating energy at the point plate 12*f* is near failure. Straps 30*f* may be referred to herein as tension straps, although it will be appreciated that straps 30*f* are not limited to operating under tension, and at times may also be acted upon under compression in a cyclical loading system. In such an embodiment such as that illustrated in FIGS. 7A-7C, for example, while one strap 30*f* is in tension and elongates and/or straightens, another strap 30*f* may be under compression such that it contracts and/or increases its arch.

It should be appreciated in view of the disclosure herein that the embodiment illustrated in FIGS. 7A-7C are merely exemplary, however, and that other embodiments are possible. For example, in some cases straps 30*f* may be attached to the same surface of plate 12*f* and extend in parallel and/or perpendicular directions.

As further illustrated in FIGS. 7A-7C, and as discussed elsewhere herein, a seismic damper 10*f* can include a flat plate 12*f* having one or more internal perforations or apertures 14*f*, 15*f* and one or more cut-outs 16*f* along the edges of flat plate 12*f*. In the illustrated embodiment, for instance, four cut-outs 16 are formed in an otherwise substantially square plate, while the corners of the substantially square plate are also optionally removed, thereby forming a plate 12*f* that is generally cross-shaped. As discussed herein, this is merely exemplary as numerous other configurations are possible for a seismic damper according to the present invention, including at least those disclosed herein with respect to FIGS. 1A-6, 8A and 8B.

Furthermore, and as best shown in FIG. 7C (in which strap 30*f* is illustrated as at least partially transparent so as to provide greater clarity), a central aperture 14*f* may be formed on the center of plate 12*f*, and centered between tabs 20*f* and nodes 18*f* of the seismic damper 10*f*. In this case, a generally circular aperture 14*f* is formed with its center on the center of flat plate 12*f*, although this is exemplary only, and in other embodiments there may be no aperture formed on the center of flat plate 12*f*, or multiple apertures may be formed around the center of flat plate 12*f*.

As also illustrated in this embodiment, a series of additional perforations/apertures 15*f* may also be formed around, but not on, the center of plate 12*f*. By way of example only, the additional perforations 15*f* may be placed around the perimeter of the central aperture in a regular or irregular fashion. In FIG. 7C, for example, the circular perimeter apertures 15*f* are offset around the perimeter of central aperture 14*f* at substantially equal angular offsets. More particularly, in the illustrated embodiment there are eight perimeter apertures 14*f* offset at forty-five degree intervals. Of course, more or fewer apertures may be used. Additionally, while a single layer of perimeter apertures 15*f* is illustrated, there may be successive layers of perimeter apertures, such that there may be additional apertures around the perimeter of apertures 15*f*, and even more apertures around the perimeter thereof.

Accordingly, it will be appreciated in view of the disclosure herein that apertures 14*f*, 15*f* can be formed in plate 12*f* in virtually any configuration, shape or pattern. For example, while apertures 15*f* are formed around aperture 14*f* in a substantially circular manner, they could also vary in their distance from central aperture 14*f*, and could even intersect central aperture 14*f*. Additionally, the sizes can be varied. Thus, while central aperture 14*f* can have a size greater than perimeter apertures 15*f*, this is exemplary only. In other embodiments, each of apertures 14*f*, 15*f*, is of about the same size, central aperture 14*f* is smaller than perimeter apertures 15*f*, or central aperture 14*f* may be smaller than some, but larger than other, of perimeter apertures 15*f*. Indeed, as reflected herein, central aperture 14*f* can be entirely omitted in some embodiments.

As also noted herein, seismic damper 10*f* can operate by absorbing energy such that it is focused at the nodes 18*f* formed between the tabs 20*f*. In the illustrated embodiment, for example, nodes 18*f* are formed in the portion of flat plate 12*f* that narrows between cut-outs 16*f* and perimeter apertures 15*f*. It will be appreciated that while stresses concentrate in this area, it does not mean or require that all stresses be applied only to nodes 18*f*. Indeed, as discussed herein, tabs 20*f* may also expand such that some of the stresses are absorbed by tabs 20*f*. Additionally, some stresses may also act in other locations such as, for example, in the areas between perimeter apertures 15*f* and the central aperture 14*f* or the center of plate 12*f*.

Figure 8A:
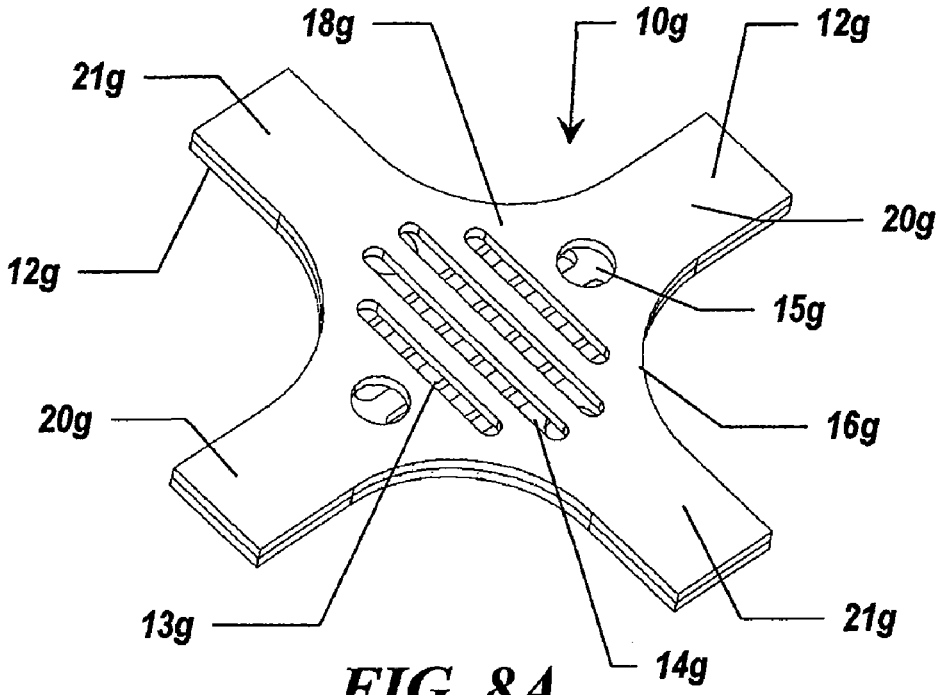
FIG. 8A illustrates a perspective view of another example embodiment of a seismic damper in which perforations in the seismic damper include slots, and in which two plates are affixed together at a ninety degree offset.
Figure 8B:
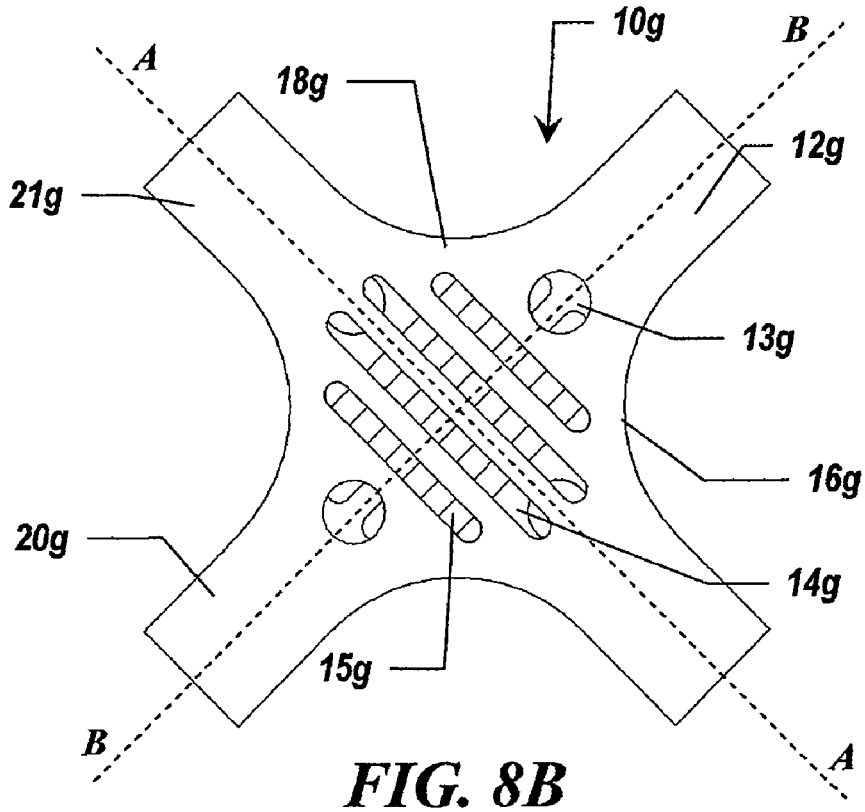
FIG. 8B illustrates the seismic damper of FIG. 8A as viewed from either the top or bottom.

Now turning to FIGS. 8A and 8B, yet another embodiment of a seismic damper 10*g* according to aspects of the present invention is disclosed. In particular, FIGS. 8A and 8B illustrate an exemplary seismic damper 10*g* having two plates 12*g* joined together and/or which have yet another alternate configuration of perforations 13*g*, 14*g*, 15*g*.

For example, in the illustrated embodiment, seismic damper 10*g* includes two plates 12*g* which are attached to each other on their respective top and bottom surfaces. As will be appreciated in view of the disclosure herein, each of flat plates 12*g* of FIGS. 8A and 8B is similar to flat plates 12*f* of FIGS. 7A-7C, except that the strap 30*f* has been removed, and the perforations have different configurations. Furthermore, in some cases flat plates 12*g* may be about half the thickness as flat plate 12*f* as the two flat plates 12*g* are connected together.

More particularly, the embodiment illustrated in FIGS. 8A and 8B also shows a seismic damper in which the flat plates 12*g* are substantially square, but which have cut-outs 16*g* formed in the edges thereof, and the corners removed to form a substantially cross-shaped seismic damper 10*g*. As noted previously, this configuration is exemplary only, and aspects of this embodiment, including at least the use of two plates and the orientation and type of perforations, can equally be applied to any seismic damper illustrated in FIGS. 1A-7C.

As compared to flat plate 12*f* of FIGS. 7A-7C, it will be appreciated that flat plates 12*g* of FIGS. 8A and 8B have removed the central aperture 14*f* and six of the eight perimeter apertures 15*f*. Instead, FIGS. 8A and 8B illustrate flat plates 12*g* which include a series of slots 13*g*, 14*g*, as well as two perimeter apertures 15*g* similar to two perimeter apertures 15*f* from seismic damper 10*f*. More particularly, the two perimeter apertures 15*g* are opposing apertures and offset at one-hundred eighty degrees, while being aligned with a center of tabs 20*g*.

More specifically, the illustrated embodiment includes a set of two central, elongate slots 14*g* which are centered around the center of flat plate 12*g*, and are reflectively symmetric about at least two axes of symmetry. In particular, elongate slots 14*g* are, in this embodiment, reflectively symmetric about a first axis of symmetry A-A which passes through the centers of opposing tabs 21*g*, and through the middle of the space between elongate slots 14*g*. A second axis of symmetry B-B passes through the centers of opposing tabs 22*g* and through the center of each of apertures 13*g*, 14*g*, and 15*g*.

A second set of elongate slots 15*g* is also illustrated in the example embodiment, and slots 15*g* are also symmetrical about the same two axes of symmetry. In this example, elongate slots are placed outward from the center of plate 12*g*, through which axis of symmetry A-A passes, and closer to tabs 20*g*. Additionally, elongate slots 15*g* can have a length which varies from that of elongate slots 14*g*. For instance, in the illustrated embodiment elongate slots 14*g* are longer than elongate slots 15*g*, although this is exemplary only. In other embodiments, for instance, elongate slots 15*g* may be longer than elongate slots 14*g*, or elongate slots 14*g*, 15*g* may be about the same length. In still other embodiments, there may be fewer or no axes of symmetry. For example, elongate slots 14*g*, 15*g* may have differing lengths, widths, configurations on opposing sides of axis of symmetry A-A or axis of symmetry B-B.

Optionally, one or more other apertures may also be included. For instance, in this embodiment, the two circular apertures 13*g* are also formed in plates 12*g* and are further offset from axis of symmetry A-A and the center of plate 12*g* (and which is generally shown by the intersection of axes of symmetry A-A and B-B). Apertures 12*g* may, however, be omitted entirely, or configured in other manners. For instance, in another embodiment, apertures may additionally or alternatively be formed near the ends of elongate slots 14*g*, 15, closer to the center of plate 12*g*, between slots 14*g*, 15*g*, or in any other suitable or desired location.

In addition, it will be appreciated that the spacing between apertures 13*g*, 14*g* and 15*g*, whether in the form of slots, circles, or in any other shape, may also be substantially equal, or may be varied. Furthermore, while multiple slots and apertures are illustrated, the number, orientations and configurations may also be varied. For instance, in one embodiment slots may be formed on the same plate 12*g* so as to be perpendicular or orthogonal with respect to other slots. In another alternative, a single slot may be used and, for example, may be centered such that it runs along either illustrated axis of symmetry, or angularly offset with respect thereto. Accordingly, while the illustrated embodiment shows tabs 20*g* which are near apertures 13*g* and at least partially different than tabs 21 which are instead near the ends of slots 14*g*, in other embodiments each of the tabs is identical. In still other embodiments all of the tabs may be different, or other configurations may be used.

In the illustrated embodiment, the two plates 12*g* collectively form a substantially flat perforated member, although each single plate is also properly considered a substantially flat perforated member. In the collective use of plates 12*g*, it can be seen that plates 12*g* may each be substantially identical, such that when joined together, the tabs 20*g*, 21*g*, cut-outs 16*g*, and nodes 18*g* can be placed in alignment with each other. In some embodiments, identical perforations are also formed and, when plates 12*g* are aligned, perforations 13*g*, 14*g*, and 15*g* are also in alignment such that slots 13*g* in one plate 12*g* align with substantially identical slots in the other plate 12*g*, while slots 14*g* and apertures 15*g* in that plate 12*g* also align with substantially identical slots and apertures, respectively, in the other plate 12*g*.

In another embodiment, however, such as that illustrated in FIGS. 8A and 8B, the perforations of plates 12*g* may not be in substantial alignment. Such may occur where, for example, the perforations are not substantially identical. Alternatively, or in addition thereto, perforations may be out of alignment because one plate is rotated relative to the other plate.

The latter is the case in the illustrated embodiment, in which plates 12*g* are substantially identical, but in which perforations 13*g*, 14*g*, and 15*g* are out of alignment. In particular, as can best be seen in FIG. 8B, slots 13*g*, 14*g* in the top plate 12*g* run perpendicular to the equivalent slots in the bottom plate 12*g*. Similarly, apertures 13*g* of the top plate are out of alignment with the equivalent apertures in the bottom plate 12*g* and are, in this example, also rotated about the center of seismic damper 10*g* by ninety degrees. More specifically, top plate 12*g* is rotated ninety degrees with respect to bottom plate 12*g*, such that the axes of symmetry are also rotated with respect thereto. Thus, axis of symmetry A-A of top plate 12*g* is aligned with the equivalent of axis of symmetry B-B for bottom plate 12*g*, while axis of symmetry B-B of top plate 12*g* is aligned with the equivalent of axis of symmetry A-A for bottom plate 12*g*.

In describing the behavior of seismic damper 10*g*, only the top plate 12*g* will be described, although it will be appreciated that an equivalent discussion may be had with respect to the bottom plate 12*g*. More particularly, as noted above, plate 12*g* may be placed in tension or compression, or cyclically in both tension and compression. When plate 12*g* is placed in tension along axis A-A or another axis parallel to slots 13*g* or 14*g*, the material in the center of plate 12*g* can be placed in heavy tension. When plate 12*g* is placed in tension along axis B-B or another axis perpendicular to slots 13*g*, 14*g*, the force can be directed around the sides of slots 13*g*, 14*g*, causing the plate 12*g* to bend as it elongates. In such case, plate 12*g* could also experience contraction in the direction parallel to slots 13*g*, 14*g*.

Notably, when top plate 12*g* is combined with bottom plate 12*g* in the manner illustrated in FIGS. 8A and 8B, namely with the slots 13*g*, 14*g* of the two plates 12*g* out of alignment, and seismic damper 10*g* is placed in tension along either axis, a combination of the behaviors described above can occur. The top plate 12*g*, for example, may resist a tensile force with the material parallel to the force, while bottom plate 12*g* can elongate in the direction of the applied force and contract in the direction perpendicular to the applied force. When the force is released and the seismic damper is pulled in tension along the perpendicular axis, the top plate that experienced contraction can now be forced to elongate, while the bottom plate that experienced elongation may now experience bending forces and/or contraction.

The foregoing examples are illustrative only and are not necessarily limiting of the application. For example, the embodiment disclosed with respect to FIGS. 8A and 8B, need not necessarily have a substantially flat member with two flat plates. In one example, only a single plate is used and has perforations extending fully therethrough. Such an example may additionally, or alternatively, also include a tension strap as described herein. In another embodiment, a single plate is used and perforations are formed to pass only partially through the thickness of the plate. In still other embodiments, additional plates can be combined so that three or more plates may be stacked or otherwise combined together.

Accordingly, in view of the various embodiments disclosed herein, it will be appreciated that a seismic damper according to aspects of the present invention can include any of a variety of configurations, features, shapes, and sizes. Accordingly, the features and configurations illustrated and described herein are not limited to use with any particularly sized, shaped or constructed seismic damper. Rather, each feature should be seen as being applicable for use with any other non-exclusive feature described herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of claims are to be embraced within their scope.

What is claimed is:

1. A seismic damper, comprising:

a substantially flat plate configured to be attached to a structure and absorb energy therefrom, said plate comprising:

a plurality of nodes, wherein each of said plurality of nodes is formed along a respective edge of said plate, and wherein each node of said plurality of nodes is defined as a narrowing portion of said plate substantially aligned between one or more internal perforations in said plate and a cut-out formed along said respective edge of said plate, wherein at least a portion of each node of said plurality of nodes has an interior surface defined by said one or more internal perforations and an outer surface defined by one of said cut-outs; and a plurality of tabs to be connected to cross bars, each node of said plurality of nodes being connected to two of said adjacent tabs, wherein said plurality of tabs intersect with adjacent tabs at said plurality of nodes.

2. A seismic damper as recited in claim 1, wherein said plate further comprises a first face and a second face, wherein said one or more internal perforations intersect and extend between said first face and said second face.

3. A seismic damper as recited in claim 2, further comprising:

a tension strap mounted on at least one of said first face and said second face.

4. A seismic damper as recited in claim 3, wherein said tension strap is connected to at least two tabs of said plurality of tabs of said substantially flat plate.

5. A seismic damper as recited in claim 4, wherein said at least two tabs are exactly two tabs, and said exactly two tabs are opposing, such that said exactly two tabs do not intersect with each other at a node.

6. A seismic damper as recited in claim 3, wherein said tension strap is arched such that as said substantially flat plate deforms, said tension strap straightens.

7. A seismic damper as recited in claim 2, further comprising:

a first tension strap mounted to said first face of said substantially flat plate; and a second tension strap mounted to said second face of said substantially flat plate.

8. A seismic damper as recited in claim 7, wherein said first tension strap extends in a direction substantially perpendicular to a direction in which said second tension strap extends.

9. A seismic damper as recited in claim 1, wherein said one or more internal perforations includes a plurality of perforations.

10. A seismic damper as recited in claim 9, wherein said plurality of perforations includes a plurality of holes.

11. A seismic damper as recited in claim 9, wherein said plurality of perforations includes at least one elongate slot.

12. A seismic damper as recited in claim 9, wherein said plurality of perforations includes a plurality of holes and a plurality of elongate slots.

13. A seismic damper as recited in claim 1, wherein said substantially flat plate is a first substantially flat plate, the seismic damper further comprising:

a second substantially flat plate configured to be attached to the first substantially flat plate and to a structure so as to absorb energy from said structure, said second substantially flat plate being substantially identical to said first substantially flat plate.

14. A seismic damper as recited in claim 13, wherein said second substantially flat plate is attached to said first substantially flat plate and said second substantially flat plate is rotated relative to said substantially flat plate such that said plurality of tabs on said first substantially flat plate align with the plurality of tabs on said second substantially flat plate, while at least one of said one or more internal perforations of said first substantially flat plate does not align with said one or more internal perforations of said second substantially flat plate.

* * * * *